United States Patent [19]

Mori et al.

[11] Patent Number: 4,805,516

[45] Date of Patent: Feb. 21, 1989

[54] AXIAL AIR MOTOR

[75] Inventors: Nobuo Mori; Terumasa Takeuchi, both of Aichi; Hiroshi Kiyohara, Fukushima, all of Japan

[73] Assignee: CKD Corporation, Aichi, Japan

[21] Appl. No.: 95,577

[22] Filed: Sep. 11, 1987

[30] Foreign Application Priority Data

Sep. 12, 1986 [JP] Japan ..... 61-215348

[51] Int. Cl.[4] ..... F01B 3/10; F01B 3/02

[52] U.S. Cl. ..... 91/503; 91/180

[58] Field of Search ..... 91/180, 499, 503, 504; 417/269, DIG. 1; 92/71

[56] References Cited

U.S. PATENT DOCUMENTS

| | | | |
|---|---|---|---|
| 3,036,558 | 5/1962 | MacLoed | 91/180 |
| 3,145,629 | 8/1964 | Gottzmann | 417/DIG. 1 |
| 3,191,629 | 6/1965 | Stoyke | 91/503 |
| 3,212,411 | 10/1965 | Storms | 417/DIG. 1 |
| 3,233,554 | 2/1966 | Huber | 417/DIG. 1 |
| 3,253,410 | 5/1966 | Albers | 91/503 |
| 3,272,079 | 9/1966 | Bent | 91/175 |
| 3,353,450 | 11/1967 | Killick et al. | 91/503 |
| 3,596,569 | 8/1971 | Wisbey | 91/503 |
| 3,695,149 | 10/1972 | Eberhart | 417/DIG. 1 |
| 4,160,403 | 7/1979 | Takagi | 91/488 |
| 4,662,267 | 5/1987 | Kaku | 92/71 |
| 4,699,572 | 10/1987 | Balkau | 417/DIG. 1 |

FOREIGN PATENT DOCUMENTS

| | | | |
|---|---|---|---|
| 2618556 | 11/1977 | Fed. Rep. of Germany . | |
| 54-38721 | 11/1979 | Japan . | |
| 56-983 | 5/1981 | Japan | 91/503 |
| 144672 | 8/1983 | Japan | 91/503 |
| 260485 | 3/1949 | Switzerland | 91/505 |
| 300215 | 11/1928 | United Kingdom . | |
| 499575 | 1/1939 | United Kingdom . | |
| 792081 | 3/1953 | United Kingdom . | |
| 689706 | 4/1953 | United Kingdom . | |
| 864635 | 4/1961 | United Kingdom . | |
| 1033116 | 6/1966 | United Kingdom . | |
| 1043894 | 9/1966 | United Kingdom . | |
| 2178802 | 2/1987 | United Kingdom . | |
| 1068078 | 5/1987 | United Kingdom . | |

OTHER PUBLICATIONS

"Probleme der Steverung in Langsamläufern (Problems of Control of Slow Speed Motors)", Friedrichs, I. H., in Ölhydraulik und Pneumatik, vol. 17, No. 9, pp. 246–250, 1973.

*Primary Examiner*—William L. Freeh

*Attorney, Agent, or Firm*—Wenderoth, Lind & Ponack

[57] ABSTRACT

An axial air motor having a plurality of cylinders disposed around the axis of rotation of an output shaft in such a manner that the direction of movement of the pistons is parallel with the output shaft. The air motor is provided with a swash plate which is rotatably mounted on the output shaft through a bearing and which is directly pressed by means of a ball which is mounted on each piston. Accordingly, the structure of the motor as a whole is simplified and the frictional resistance occurring between constituent parts can be minimized. Thus, it is possible to achieve an efficient axial air motor. Further, since a lubricant can be charged in a hole for receiving the ball in advance, it is possible to reduce the frictional resistance occurring between the ball and the swash plate even in a non-lubricated operation.

9 Claims, 3 Drawing Sheets

AXIAL AIR MOTOR

BACKGROUND OF THE INVENTION

The present invention relates to an air motor and, more particularly, to an axial air motor having a plurality of cylinders disposed around the axis of rotation of an output shaft in such a manner that the direction of movement of the pistons is parallel with the output shaft.

So-called axial motors have heretofore been well known in which a plurality of cylinders are disposed around the axis of rotation of an output shaft in such a manner as to extend parallel with said axis and pressure is applied to a swash plate mounted on the output shaft by means of pistons respectively received in the cylinders, thereby rotating the output shaft. Most of the axial motors are oil-hydraulic motors that use oil as a working fluid as shown in, for example, the specification of Japanese Patent Publication No. 54-38721, and air motors that use air as a working fluid have not heretofore been widely used.

More specifically, since air is used as a working fluid axial oil-hydraulic motors cannot be utilized as air motors without change or modification for the following reasons:

First, since air motors are generally rotated at higher speed than oil-hydraulic motors, the mass of movable parts of the former must be made smaller than the latter to as large an extent as possible so that inertia force is minimized.

Secondly, since air motors are rotated at higher speed than oil-hydraulic motors and the working pressure of the former is lower than that of the latter, the frictional resistance of working parts of the air motors must be minimized.

Thirdly, although in the case of oil-hydraulic motors the working fluid per se has a lubricating function, it is necessary in the case of air motors to contrive smooth lubrication between working parts in view of the fact that there has been a recent tendency to adopt the oil-less method for air motors (wherein no lubricant is sprayed in air).

SUMMARY OF THE INVENTION

The present invention relates to an air motor and, more particularly, to an axial air motor having a plurality of cylinders disposed around the axis of rotation of an output shaft in such a manner that the direction of movement of the pistons is parallel with the output shaft.

It is an object of the present invention to provide an axial air motor which is so designed that the mass of movable parts of the motor is minimized to reduce the inertia of the movable parts, thus enabling air to be employed as a working fluid.

It is another object of the present invention to provide an axial air motor in which the mass and inertia of movable parts of the motor are minimized by omitting the piston rod which has heretofore been used to transmit the power of the piston of each cylinder to the swash plate.

It is still another object of the present invention to provide an air motor which is so designed that the frictional resistance occurring at the area of contact of each of the movable parts is reduced to enable air to be employed as a working fluid.

To these ends, the present invention provides an axial air motor having a housing, an output shaft, a swash plate mounted on the output shaft in inclined relationship with respect to the axis of rotation of the output shaft, a plurality of cylinder holes formed in said housing around the axis of rotation of the output shaft and circumferentially spaced from each other, a piston movably disposed within each of the cylinder holes and adapted to press the swash plate, and a control valve adapted to operate in response to the rotation of the output shaft so as to control the supply of air to the cylinder holes, wherein the swash plate is rotatably mounted on the output shaft through a bearing, and a ball is rollably mounted on the piston, the ball being in contact with the swash plate such as to be capable of pressing against it.

In the axial air motor according to the present invention, the swash plate is rotatably mounted on the output shaft through a bearing and is directly pressed by means of a ball which is mounted on each piston. Accordingly, the structure of the motor as a whole is simplified and the frictional resistance occurring between constituent parts can be minimized, so that it is possible to achieve an efficient axial air motor.

Since the present invention enables a lubricant to be charged in a hole for receiving the ball in advance, it is possible to reduce the frictional resistance occurring between the ball and the swash plate even in a non-lubricated operation, and it is also possible to effectively use the lubricant by circulating it.

Further, according to the present invention, a seal member made from a plastic material impregnated with a lubricant may be provided around the outer periphery of each piston of the air motor, so that it is possible to run the motor smoothly even in a non-lubricated operation.

The above and other objects, features and advantages of the present invention will become apparent from the following description of the preferred embodiment thereof taken in conjunction with the accompanying drawings.

DETAILED DESCRIPTION OF THE PREFERRED EMBODIMENTS

Figure 1:
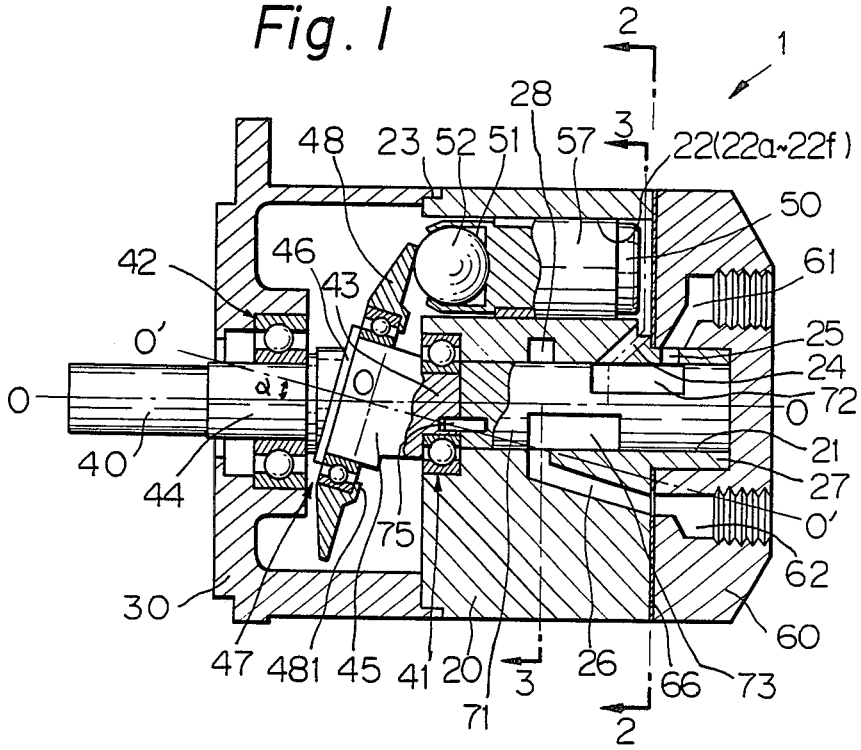
FIG. 1 is a sectional view of one embodiment of the axial air motor according to the present invention.
Figure 2:
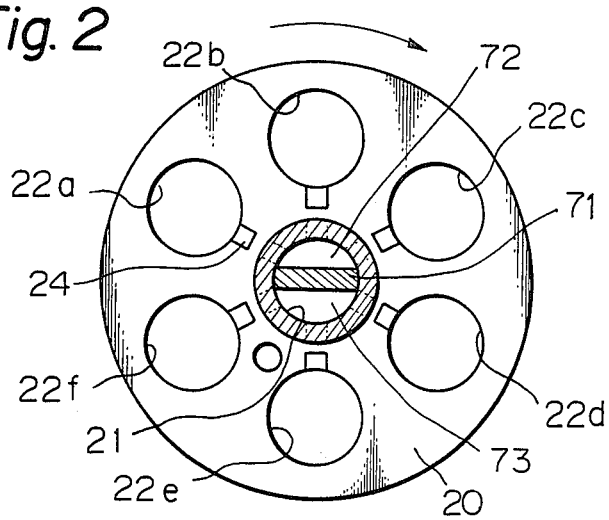
FIG. 2 is a sectional view taken along the line 2—2 of FIG. 1.
Figure 3:
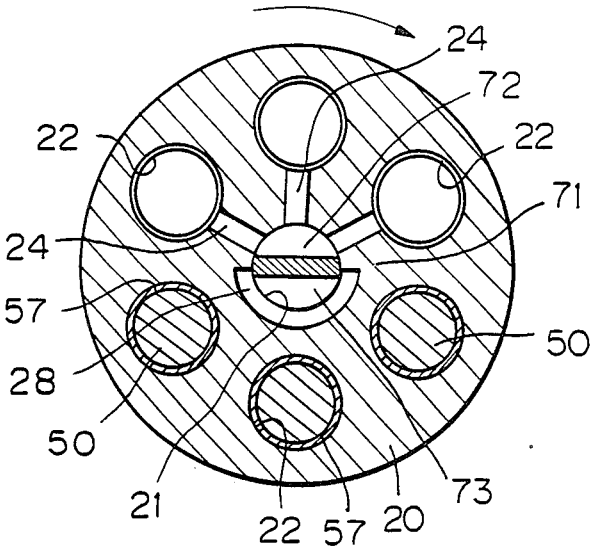
FIG. 3 is a sectional view taken along the line 3—3 of FIG. 1.

Referring to the accompanying drawings, particularly to FIG. 1, an axial air motor in accordance with a preferable embodiment is generally denoted by the reference numeral 1. In FIGS. 1 to 3, the air motor 1 includes a housing having a cylinder block 20 and front and rear covers 30, 60 which are attached to the cylinder block 20. The cylinder block 20 is provided with a valve hole 21 axially extending therethrough and a plurality (6 in this embodiment) of cylinder holes 22 equally spaced away from each other in the circumferential direction. The air motor 1 further includes an output shaft 40 rotatably supported by bearings 41 and 42 which are respectively attached to the cylinder block 20 and the front cover 30 in such a manner that the output shaft 40 extends coaxially with respect to the cylinder block 20, and a swash plate 48 which is rotatably mounted on the output shaft 40 through a bearing 47 in such a manner that the axis of rotation of the swash plate 48 intersects that of the output shaft 40 at an angle.

A recess 23 is formed in the outer periphery of one end (the left end as viewed in FIG. 1) of the cylinder block 20, and one end (the right end as viewed in FIG. 1) of the front cover 30 is fitted into the recess 23, whereby the cylinder block 20 and the front cover 30 are held in coaxial relation to each other. The cylinder block 20 and the front cover 30 are secured to each other by means of known setscrews (not shown) which extend through the front cover 30 and which are screwed into the cylinder block 20.

The output shaft 40 is rotatably supported at one end portion (the right end portion as viewed in FIG. 1) 43 by the bearing 41 which is fitted in one end of the cylinder block 20, and the central portion 44 of the output shaft 40 is rotatably supported by the bearing 42 which is fitted in the front cover 30. The output shaft 40 has a slanting portion 45 which is formed between the portions 43 and 44 in such a manner that the central axis of the portion 45 intersects the axis O-O of rotation of the output shaft 40 at a predetermined angle $\alpha$. A flange 46 is formed at one end of the slanting portion 45. The bearing 47 is fitted on the slanting portion 45, and the swash plate 48 which has an annular configuration is fitted on the outer side of the bearing 47. Accordingly, the swash plate 48 is rotated relative to the output shaft 40 around the axis O'—O'. The swash plate 48 is provided with a flange 481 which extends radially inward so that the flange 481 prevents the swash plate 48 from coming off the bearing 42.

Figure 5:
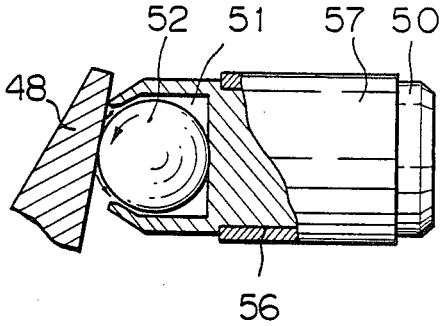
FIG. 5 is a partially-sectioned enlarged view of the piston and the ball.

A cylindrical piston 50 is received in each of the cylinder holes 22 in such a manner that the piston 50 is axially movable. A ball receiving hole 51 is formed in the end portion of each piston 50 which is closer to the swash plate 48 as shown in detail in FIG. 5, and a ball 52 made of ceramics or steel is rollably accommodated in the ball receiving hole 51. The ball receiving hole 51 also defines a lubricant reservoir and contains a lubricant for lubricating the ball 52.

Figure 6A:
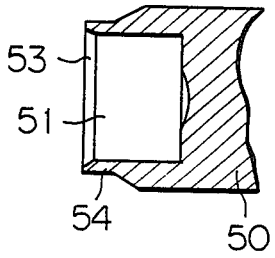
FIG. 6A is a fragmentary sectional view of the piston before the ball is inserted into the ball receiving hole.
Figure 6B:
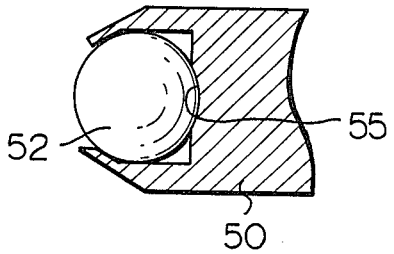
FIG. 6B is a fragmentary sectional view of the piston after the ball has been inserted into the ball receiving hole.

The ball 52 may be inserted into the ball receiving hole 51 in the manner described below. As shown in FIG. 6A, a thin-walled cylindrical portion 54 which has a chamfered portion 53 formed along the inner periphery of the opening edge of the ball receiving hole 51 is formed integral with the piston 50, and after the ball 52 has been inserted into the ball receiving hole 51, the cylindrical portion 54 is caulked inwardly as shown in FIG. 6B, thereby preventing the ball 52 from falling from the ball receiving hole 51. It should be noted that the bottom of the ball receiving hole 51 is provided with a recess 55 which defines a part of the spherical surface which is in contact with the ball 52. Although the lubricant is caused to come out of the ball receiving hole 51 by the rolling of the ball 52, it is returned thereto by virtue of the function of the chamfered portion 53.

A relatively shallow groove 56 is formed around the outer periphery of the piston 50, and a seal member or slide member 57 which is made from a plastic material impregnated with a lubricant is fitted in the groove 56. The seal member 57 guides the piston 50 in such a manner that the piston 50 is not in direct contact with the inner surface of the cylinder hole 22, and also seals the clearance space between the piston 50 and the inner surface of the cylinder hole 22 in order to prevent air from becoming wet. The seal member 57 is fitted with a predetermined tensile stress applied thereto in advance, so that, when the temperature of seal member 57 rises as a result of the rise in temperature of the piston 50 or the like, the tensile stress is reduced and radial expansion of the seal member 57 is suppressed by the reduction in the stress. More specifically, the fitting of the seal member 57 on the piston 50 as described above enables the piston 50 to move smoothly, since, even when the temperature of the piston 50 or the like rises, the clearance space between the seal member 57 and the inner surface of the cylinder hole 22 can be maintained at the same level as that before the rise of temperature.

It should be noted that the structure of this seal member 57 is not necessarily essential to the present invention.

A communicating bore 24 is formed in the other end portion (the right end portion as viewed in FIG. 1; this end will hereinafter be referred to as the "second end") of the cylinder block 20 for each of the cylinder hole 22, the bore 24 extending obliquely inward in the radial direction from the opening edge of the cylinder hole 22. Accordingly, the cylinder holes 22 are communicated with the valve hole 21 through the respective communicating bores 24. A sleeve-shaped portion 27 is formed so as to project from the center of the second end of the cylinder block 20, and the rear cover 60 is fitted on the sleeve-shaped portion 27. The rear cover 60 is brought into contact with the end face of the cylinder block 20 through a packing 66 and secured thereto by means of known setscrews (not shown). The valve hole 21 is communicated with an air supply port 61 provided in the rear cover 60 via a communicating bore 25 which is formed in the sleeve-shaped portion 27. The valve hole 21 is also communicated with an exhaust port 62 provided in the rear cover 60 via an annular groove 28 and a communicating bore 26. The respective opening ends (closer to the valve hole 21) of the communicating bores 24, 25 and 26 are spaced away from each other in the axial direction.

A cylindrical valve body 71 is rotatably disposed within the valve hole 21. The valve body 71 constitutes a switching valve and has notches 72 and 73 which are formed at diametrically opposite positions, respectively, in such a manner that the notches 72 and 73 are slightly offset from each other in the axial direction. The notch 72 allows three communicating bores 24 to communicate with the communicating bore 25 simultaneously, while the notch 73 allows three communicating bores 24 at the opposite side to communicate with the communicating bore 26 at the same time.

Figure 7A:
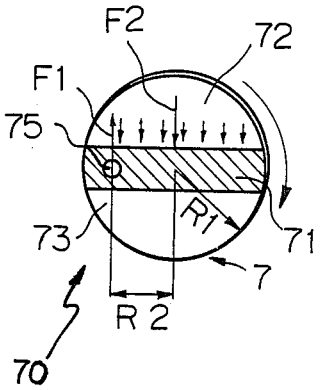
FIG. 7A shows the way in which the air pressure acts on the valve body and the way in which the rotational force acts on the pin in the case where the air pressure and the rotational force act in opposite directions to each other.

The valve body 71 and the output shaft 40 are coupled together by means of a pin 75 provided at a position which is eccentric with respect to the axis O-O, so that the rotation of the output shaft 40 is transmitted to the valve body 71. Although there is no specific restriction on the position of the pin 75 with respect to the output shaft 40, the position of the pin 75 with respect to the valve body 71 must be located between the two notches 72 and 73 and the pin 75 must be disposed at the downstream side of the air supply notch 72 as viewed in the direction of rotation of the valve body 71, as shown in FIG. 7A. More specifically assuming that the upper notch is the notch 72 and the valve body 71 rotates clockwise, the pin 75 is disposed at a position to the left of center.

Figure 7B:
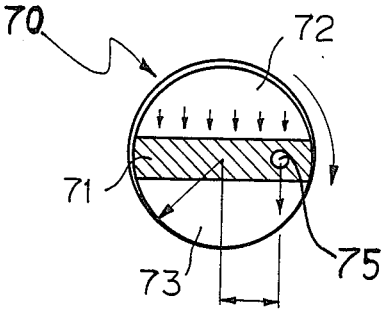
FIG. 7B shows the way in which the air pressure acts on the valve body and the way in which the rotational force acts on the pin in the case where the air pressure and the rotational force act in the same direction.

The reason for this is explained below. When fluid pressure acts on the notch 72, the valve body 71 is pressed toward the notch 73 within the valve hole 21. Accordingly, if the pin 75 is positioned as shown in FIG. 7A, the valve body 71 is pressed toward the notch 72 by means of the rotational force F1 which is applied to the valve body 71 by the pin 75 (although the position of the pin 75 is eccentric), so that it is possible to lessen the force F2 applied by the air pressure. If the pin 75 is disposed at a position opposite to the above as shown in FIG. 7B, the rotational force which acts on the valve body 71 so as to press the latter toward the notch 73 is added to the pressure applied by the air within the notch 72, which hinders the valve body 71 from rotating smoothly.

In the above-described arrangement, when pressurized air is supplied to the air supply port 61, the air is successively introduced into the cylinder holes 22 by the action of the control valve 70. More specifically, it is assumed that the piston 50 in the cylinder hole 22*c* is withdrawn the most. When, in this state, pressurized air is supplied to the air supply port 61, the air is first introduced into the cylinder holes 22*a*, 22*b* and 22*c* by the action of the control valve 70 to press the pistons 50 therein toward the swash plate 48. In consequence, the ball 52 on the piston 50 presses the swash plate 48 away from the cylinder block 20, causing the output shaft 40 to begin to rotate in the direction of the arrow in FIG. 2. Thus, the valve body 71 also begins to rotate together with the output shaft 40, and when the valve body 71 rotates through a predetermined angle, the pressurized air is sent to the cylinder holes 22*b* to 22*d*, causing the piston 50 in the cylinder hole 22*d* to begin to move. Thereafter, the valve body 71 rotates in synchronism with the rotation of the output shaft 40 in the same manner as the above, and the cylinder holes 22 which are to be supplied with the pressurized air are automatically switched by the action of the control valve 70. In this way, the output shaft 40 continues to rotate. The rotational speed of the output shaft 40 is proportional to the pressure of the pressurized air.

Figure 4:
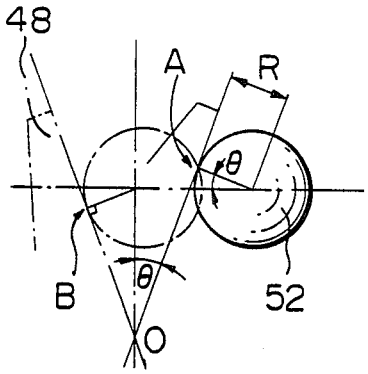
FIG. 4 shows changes of the positional relationship between the ball and the swash plate in accordance with the change in position of the piston.

When the ball 52 presses the swash plate 48, the point of contact of the ball 52 with the swash plate 48 changes as shown in FIG. 4, and therefore the ball 52 must rotate around on its own axis or slide. However, the lubricant contained in the ball receiving hole 51 allows the ball 52 to roll freely. Further, since the piston 50 is guided by the slide member 56 which is made from a plastic material impregnated with a lubricant, the piston 50 can reciprocate smoothly.

Figure 8:
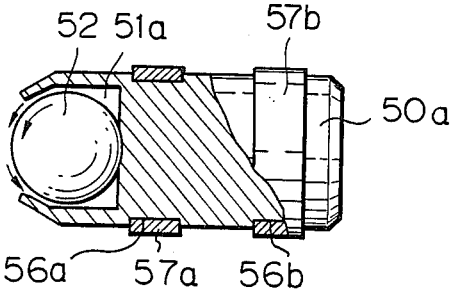
FIG. 8 shows a modification of the seal member.

FIG. 8 shows a modification of the seal member. The illustrated seal member consists of two portions 57*a* and 57*b* which are respectively fitted in two grooves 56*a* and 56*b* axially spaced away from each other on the outer periphery of the piston 50*a*.

Although in the above-described embodiments the number of cylinders is six, said number is not necessarily limited to six, but the number of cylinders may be selected as desired, for example, four, five or eight. Further, the bearings 41, 42 and 47, which are defined by ball bearings in the described embodiment, may be defined by roller bearings or other types of bearing.

What is claimed is:

1. An axial air motor comprising:

a housing;

an output shaft rotatably supported by said housing;

a swash plate rotatably mounted on said output shaft and having an inclined relationship with respect to the axis of rotation of said output shaft;

a plurality of cylinder holes in said housing around the axis of rotation of said output shaft and circumferentailly spaced from each other;

a piston movably disposed within each of said cylinder holes for pressing against said swash plate, each said piston having a ball receiving hole at one end thereof adjacent said swash plate, and said ball receiving hole having a chamferred portion in the inner periphery of the open end of said ball receiving hole;

a control valve operatively connected to said output shaft for controlling the supply of air to said cylinder holes; and a ball and lubricant received within said ball receiving hole, said ball being ceramic and contacting said swash plate for pressing against said swash plate and for being rotated thereby, the rotation of said ball bringing a part of said lubricant out of said ball receiving hole, and said chamferred portion returning some of the part of said lubricant brought out of said hole back into said hole.

2. An axial air motor according to claim 1, further comprising a plurality of seal members fitted on the outer periphery of said piston, each said seal member being under a predetermined tensile stress for substantially eliminating an increase in radius of each said seal member caused by thermal expansion thereof when said axial air motor is in use, said seal members being axially spaced away from each other, and said seal members being a plastic material impregnated with a lubricant.

3. An axial air motor according to claim 2, further comprising a valve hole in said housing, said valve body being rotatably received in said valve hole, and a communicating bore in said housing for fluidly communicating each of said plurality of cylinder holes with said valve hole.

4. An axial air motor according to claim 2, wherein said control valve has a cylindrical valve body which is rotatably disposed at the center of a circle on which said cylinder holes are arranged and which has an air communicating notch formed in the peripheral portion thereof, and a pin couples said valve body to said output shaft.

5. An axial air motor according to claim 4, further comprising a valve hole in said housing, said valve body being rotatably received in said valve hole, and a communicating bore in said housing for fluidly communicating each of said plurality of cylinder holes with said valve hole.

6. An axial air motor according to claim 1, further comprising a seal member fitted on the outer periphery of said piston, said seal member being under a predetermined tensile stress sufficient for substantially eliminating an increase in radius of said seal member caused by thermal expansion thereof when said axial air motor is in use, and said seal member being a plastic material impregnated with a lubricant.

7. An axial air motor according to claim 1, wherein said control valve has a cylindrical valve body which is rotatably disposed at the center of a circle on which said cylinder holes are arranged and which has an air communicating notch formed in the peripheral portion thereof, and a pin couples said valve body to said output shaft.

8. An axial air motor according to claim 6, wherein said control valve has a cylindrical valve body which is rotatably disposed at the center of a circle on which said cylinder holes are arranged and which has an air communicating notch formed in the peripheral portion thereof, and a pin couples said valve body to said output shaft.

9. An axial air motor according to any one of claims 6 to 8, further comprising a valve hole in said housing, said valve body being rotatably received in said valve hole, and a communicating bore in said housing for fluidly communicating each of said plurality of cylinder holes with said valve hole.

* * * * *